US006866359B2

(12) United States Patent
Pan et al.

(10) Patent No.: US 6,866,359 B2
(45) Date of Patent: Mar. 15, 2005

(54) INK JET PRINTHEAD QUALITY MANAGEMENT SYSTEM AND METHOD

(75) Inventors: Yichuan Pan, San Diego, CA (US); Mark Broschart, San Diego, CA (US); Peter J. Fellingham, San Diego, CA (US); Timothy T. Grady, Poway, CA (US)

(73) Assignee: Eastman Kodak Company, Rochester, NY (US)

( * ) Notice: Subject to any disclaimer, the term of this patent is extended or adjusted under 35 U.S.C. 154(b) by 132 days.

(21) Appl. No.: 10/042,946

(22) Filed: Jan. 8, 2002

(65) Prior Publication Data

US 2002/0113835 A1 Aug. 22, 2002

Related U.S. Application Data

(60) Provisional application No. 60/260,506, filed on Jan. 9, 2001.

(51) Int. Cl.[7] ..... B41J 29/393; B41J 2/045; B41J 2/175

(52) U.S. Cl. ..... 347/19; 347/71; 347/87

(58) Field of Search ..... 347/5, 7, 9, 14, 347/19, 68–72, 86, 87, 180–182

(56) References Cited

U.S. PATENT DOCUMENTS

| | | | | |
|---|---|---|---|---|
| 4,268,861 | A | 5/1981 | Schreiber et al. | 358/138 |
| 4,500,919 | A | 2/1985 | Schreiber | 358/78 |
| 4,509,057 | A | 4/1985 | Sohl et al. | 347/19 |
| 4,888,618 | A | 12/1989 | Ishikawa | 355/208 |
| 4,990,004 | A | 2/1991 | Kawahara et al. | 400/56 |
| 5,049,898 | A | 9/1991 | Arthur et al. | 347/19 |
| 5,056,042 | A | 10/1991 | Lieb | 347/144 |
| 5,160,938 | A | 11/1992 | Fargo et al. | 347/19 |
| 5,185,673 | A | 2/1993 | Sobol | 358/296 |
| 5,212,546 | A | 5/1993 | Arazi et al. | 358/80 |
| 5,227,809 | A | 7/1993 | Carpenter et al. | 400/56 |
| 5,285,297 | A | 2/1994 | Rose et al. | 358/518 |
| 5,289,208 | A | 2/1994 | Haselby | 347/19 |
| 5,339,176 | A | 8/1994 | Smilansky et al. | 358/504 |
| 5,345,315 | A | 9/1994 | Shalit | 358/406 |
| 5,414,452 | A | 5/1995 | Accatino et al. | 347/7 |

(List continued on next page.)

FOREIGN PATENT DOCUMENTS

| | | | |
|---|---|---|---|
| EP | 0 412 459 A2 | 2/1991 | B41J/2/175 |
| EP | 0 571 093 A2 | 11/1993 | B41J/2/175 |
| EP | 0 668 165 A2 | 2/1995 | B41J/2/17 |
| EP | 0 709 213 A2 | 10/1995 | B41J/2/195 |
| EP | 0 982 134 A2 | 7/1999 | B41J/2/05 |
| EP | 0 980 758 A2 | 8/1999 | B41J/2/14 |
| EP | 1 023 997 A2 | 1/2000 | B41J/2/045 |
| JP | 62158049 | 7/1987 | B41J/3/04 |
| WO | WO 90/00974 | 2/1990 | B41J/3/04 |
| WO | WO 94/11848 | 5/1994 | G06K/19/077 |
| WO | WO 96/14989 | 5/1996 | B41J/11/00 |

*Primary Examiner*—Stephen D. Meier
*Assistant Examiner*—An H. Do
(74) *Attorney, Agent, or Firm*—Mark G. Bocchetti

(57) ABSTRACT

A printhead cartridge for use with an ink jet printer is disclosed. The printhead cartridge includes a memory element for storing jet characteristics of the cartridge. These characteristics can be measured during fabrication, upon installation into the printer, or during the operation of the printer. The printer adjusts printing parameters to compensate for the out of specification characteristics for optimized image quality. The compensation is done through adjusting drop ejection energy, thermal control, or replacing failed jets with substitute jets in the printhead. Alternatively, the printer accesses the measured characteristics to determine if they are within specification. If the printhead cartridge does not meet specifications, the user is instructed to remove the printhead cartridge since its use may adversely affect the quality of the resulting image. The printer accesses the measured characteristics throughout the life of the cartridge to ensure the quality of the resulting image does not degrade.

24 Claims, 4 Drawing Sheets

U.S. PATENT DOCUMENTS 5,428,379 A 6/1995 Kaneko et al. ..... 347/23
5,439,302 A 8/1995 Andou et al. ..... 400/124.07
5,488,396 A 1/1996 Burke et al. ..... 347/37
5,491,540 A 2/1996 Hirst ..... 399/12
5,506,611 A * 4/1996 Ujita et al. ..... 347/19
5,513,017 A 4/1996 Knodt et al. ..... 358/41
5,518,324 A 5/1996 Campbell et al. ..... 400/56
5,519,419 A 5/1996 Stephany et al. ..... 347/14
5,530,460 A 6/1996 Wehl ..... 347/19
5,566,372 A 10/1996 Ikeda et al. ..... 355/208
5,585,825 A 12/1996 Kneezel et al. ..... 347/14
5,592,202 A 1/1997 Erickson ..... 347/37
5,600,350 A 2/1997 Cobbs et al. ..... 347/19
5,608,430 A 3/1997 Jones et al. ..... 347/8
5,610,635 A * 3/1997 Murray et al. ..... 347/7
5,610,636 A 3/1997 Hanabusa et al. ..... 347/19
5,617,516 A 4/1997 Barton ..... 347/17
5,646,660 A 7/1997 Murray ..... 347/59
5,672,020 A 9/1997 Leonard et al. ..... 400/69.4
5,760,799 A 6/1998 Inui et al. ..... 347/19
5,812,156 A 9/1998 Bullock et al. ..... 347/19
6,000,773 A 12/1999 Murray et al. ..... 347/19
6,199,969 B1 * 3/2001 Haflinger et al. ..... 347/19
6,227,643 B1 5/2001 Purcell et al. ..... 347/19
6,302,511 B1 10/2001 Neese et al. ..... 347/19
6,315,381 B1 * 11/2001 Wade et al. ..... 347/19
6,347,857 B1 2/2002 Purcell et al. ..... 347/19
6,467,864 B1 * 10/2002 Cornell ..... 347/14

* cited by examiner

INK JET PRINTHEAD QUALITY MANAGEMENT SYSTEM AND METHOD

This application claim priority to U.S. Provisional Application No. 60/260,506 entitled "Ink Jet Printhead Quality Management System and Method" and filed on Jan. 9, 2001.

BACKGROUND

1. Field of the Invention

The invention relates generally to ink jet printing and in particular to measuring print cartridge characteristics to improve and maintain the quality of printed images.

2. Description of the Related Art

In contrast to laser printers, which use dry ink, static electricity, and heat to place and bond the ink onto the media; ink jet printers eject extremely small droplets of wet ink onto the media. Two common techniques used to eject these small droplets rely on either heat, in a thermal ink jet, or pressure waves, in a piezo electric ink jet, to dislodge each ink droplet. These small droplets are ejected from an array of nozzles, often smaller in diameter than a human hair. The nozzle is part of a jet which is the basic drop ejection element and includes the nozzle, the fluid feature under the nozzle, and the ejector, which is a resistor for thermal ink jet or a piezo element for piezo electric ink jet. Multiple jets are configured into a printhead, which also may contain control electronics.

Ink jet printers which rely upon heat to dislodge the ink are sometimes referred to as bubble jet printers. The term bubble jet comes from the formation of bubbles in the ink in response to the application of heat. Small resistors create this heat which causes the ink to locally vaporize and form a bubble. The resistors are formed utilizing thick or thin film technology on a substrate. Typically, one resistor per orifice or nozzle is used. Additionally, the printhead can have a thermal sensing resistor (TSR) and a bulk heater resistor for active printhead temperature control. As the bubble expands, some of the ink is pushed out of the nozzle onto the media.

To eject a drop from a jet of a printhead, the printer electronics supplies an electrical pulse to the resistor located in the jet on the printhead. The pulse energy is determined by pulse shape, pulse voltage, pulse width and resistance of the resistor. The level of drop ejection energy directly contributes to drop ejection quality. Good drop ejection quality is expected when drop ejection energy is higher than a critical energy. When drop ejection energy is slightly lower than the critical energy, unhealthy drops with small drop weight and low drop velocity are ejected. No drops are ejected when the energy is too low. Therefore the printer needs to supply high enough energy to achieve good drop ejection quality.

Printers that rely on pressure waves are known as piezoelectric ink jet printers. Piezoelectric ink jet technology uses piezo elements for drop ejection. Under application of electrical potential, the piezo element is deformed. The dimensional change of the piezo element between the energized and resting states is controlled to generate pressure waves, which cause drop ejection. Different implementations can be designed, such as "shared wall", "shear mode", "bender", and "piston" types. Electrically, a piezo element has electrical capacitance as a physical parameter. The capacitance is a good indicator of the quality of the piezo element.

Another important parameter of a piezo element in an ink jet printhead is the resonance frequency. Since the piezo element is mechanically coupled with the jet, the resonance frequency, which is measured electrically, is an indicator of the state of the piezo element and the fluid chamber of the jet. For example, an empty chamber or a clogged chamber will have different resonance frequencies. Drop ejection pulse is key to drop ejection quality of piezoelectric ink jet. The drop ejection pulse includes pulse shape, voltage, and pulse width. Though no heat is generated from the drop ejection in a piezoelectric printhead, drop weight can vary due to the environmental temperature. Printhead temperature control can be implemented, similar to the thermal ink jet printhead, for controlled drop weight or dot size on media. Methods of evaluating piezo elements are described in U.S. patent application Ser. No. 09/184,466, entitled Faulty Ink Ejector Detection In an Ink Jet Printer, now, U.S. Pat. No. 6,375,299, which is hereby incorporated in its entirety by reference.

For ink jet technology, images are made up from droplets of ink of different primary colors on media. The quality of the droplets contributes greatly to the image quality. The ink and media compatibility is another important factor. As the image quality and throughput of ink jet printers improved, they have become competitive with more traditional graphic arts production processes. Such improvements have allowed ink jet printers to become widely used in the graphic arts industry. To satisfy such users and optimize image quality, manufacturers maintain strict quality controls for a newly fabricated ink jet printer. However, wear and replacement of disposable components over time, such as the printhead or cartridge, may degrade image quality. The rigorous demands of the graphic arts industry has led ink jet printer manufacturers to focus on improving the quality of the printed image throughout the printer's usable life.

It can be appreciated that many different parameters affect the print quality achievable in ink jet printing. While ambient environmental conditions along with the selected type of ink and media may affect the result of the print process, the performance of the printhead is critical to good image quality. If one or more of the jets of the printhead is not ejecting the correct amount of ink at the right time, image quality significantly suffers.

With respect to the printhead, a variety of monitoring techniques have been developed to detect malfunctioning ink jet nozzles and warn the operator or compensate for the malfunctioning jet in some way. In most of these monitoring techniques, only jets which are not expelling ink at all, or "open" jets, can be detected. In some cases, this is accomplished by optical monitors which detect droplets of ink as they are expelled. This detection technique is complicated, and typically cannot detect jets which may be expelling some ink, but not the correct amount. Thus, these monitoring techniques are unable to provide the printer with enough information to allow it to adequately compensate for a poorly performing jet.

SUMMARY OF THE INVENTION

The invention comprises a method of accessing and using characteristics stored in a memory element on a printhead cartridge. The method includes storing in a memory element on the printhead cartridge a first set of jet characteristics of said printhead cartridge, wherein the first set of characteristics are indicative of the performance of said plurality of jets. The method also includes testing the printhead cartridge to generate a second set of jet characteristics accessible by an external device, routing the first set of characteristics from the memory element to the external device, and comparing the second set of characteristics with the first set of characteristics. In one embodiment, the method further includes adjusting printing parameters to compensate if the cartridge is not optimized. In one embodiment, these measurements are used to identify the poorly performing jets on a printhead. Once identified, the printer compensates for the poorly performing jets. If the printer is unable to compensate for the poorly performing jets, a fault message is stored in the memory element on the printhead cartridge.

Another embodiment of the invention is a printhead cartridge including a housing, and a printhead mounted to the housing, wherein the printhead has a plurality of jets thereon. The printhead cartridge further includes an integrated circuit mounted to the housing, wherein the integrated circuit includes a memory element. The memory element stores at least one set of jet characteristics.

Another embodiment of the invention is a printhead cartridge including a housing, and a printhead mounted to said housing, wherein the printhead has a plurality of jets thereon. The printhead cartridge further includes an integrated circuit mounted to the housing, the integrated circuit including a memory element, wherein said memory element stores at least one set of resistance values for resisters on the printhead.

Another embodiment of the invention is a printer including a cartridge. The cartridge includes a housing, a printhead mounted to the housing and including a plurality of jets thereon, and an integrated circuit mounted to housing. The integrated circuit includes a memory element, wherein the memory element stores a first set of characteristics of the plurality of jets, wherein the first set of characteristics comprises maximum and minimum expected resistance values of resistors on the printhead cartridge. The printer also includes a memory, wherein the memory stores a second set of characteristics of the plurality of jets, wherein the second set of characteristics comprises measured resistance values for the plurality of jet resistors. The printer also includes a processor connected to the integrated circuit by a plurality of electrical contacts, wherein the processor compares the second set of characteristics with the first set of characteristics.

Another embodiment of the invention is a method of detecting malfunctioning jets of an ink jet printhead cartridge. The method includes storing at least one jet resistance value in a memory on the cartridge, and comparing a measured resistance value to the stored value.

Another embodiment of the invention is a printer including a cartridge, wherein the cartridge includes a housing and a printhead mounted to the housing. The printhead includes a plurality of jets thereon, wherein each jet has a piezo element. The cartridge also includes an integrated circuit mounted to the housing, wherein the integrated circuit includes a memory element. The memory element stores a first set of characteristics of the plurality of jets, wherein said first set of characteristics comprises expected capacitance values for the piezo elements on said printhead. The cartridge also includes a memory, wherein said memory stores a second set of characteristics of the plurality of jets, wherein said second set of characteristics comprises measured capacitance values for the piezo elements on said printhead. the printer also includes a processor connected to the integrated circuit by a plurality of electrical contacts, wherein said processor compares said second set of characteristics with said first set of characteristics.

DETAILED DESCRIPTION OF THE INVENTION

Embodiments of the invention will now be described with reference to the accompanying Figures, wherein like numerals refer to like elements throughout. The terminology used in the description presented herein is intended to be interpreted in its broadest reasonable manner in accordance with its ordinary use in the art and in accordance with any overt definitions provided below.

Figure 1:
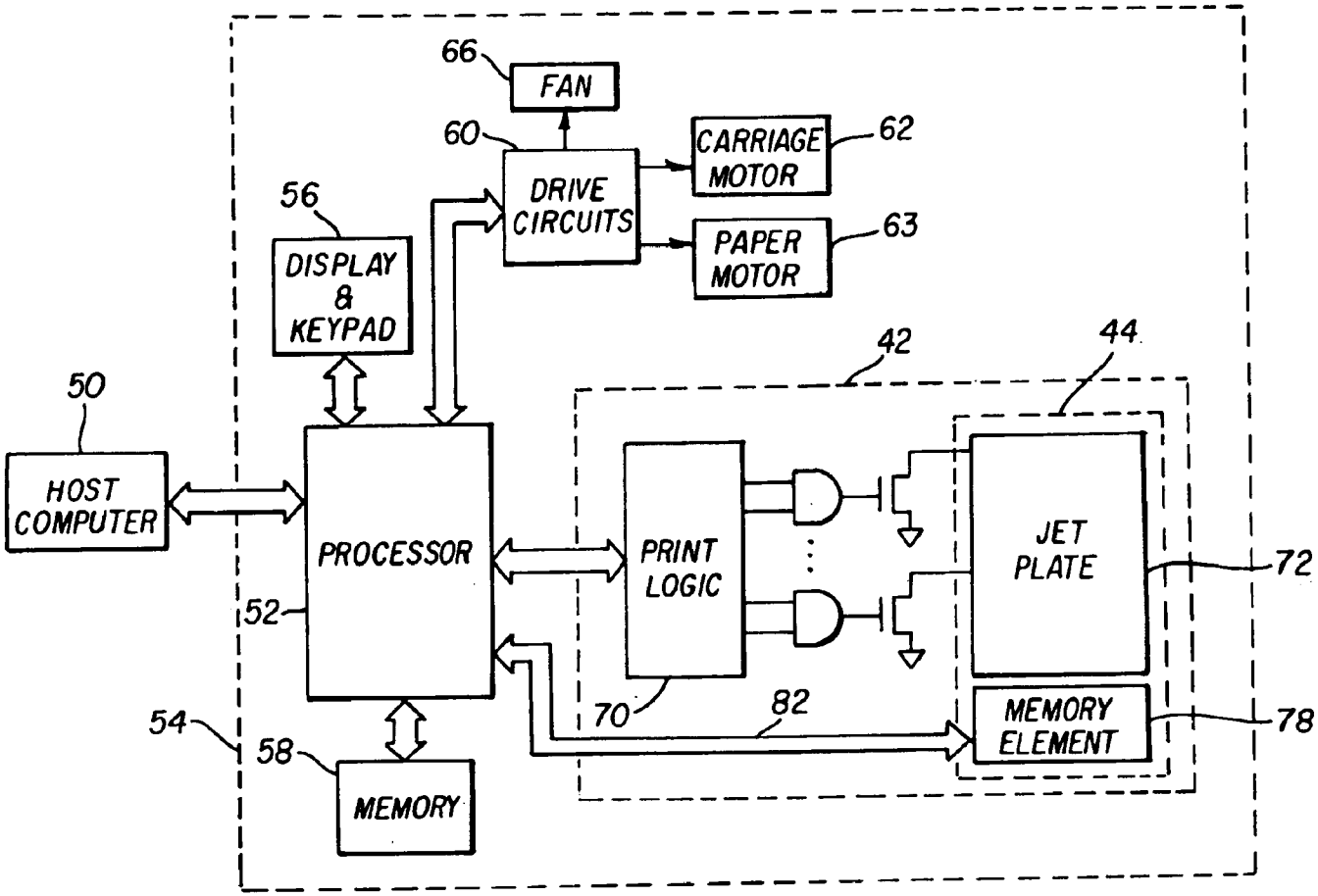
FIG. 1 is a schematic/block diagram of one embodiment of an ink jet printer according to one aspect of the invention.

Referring to FIG. 1, various components of a typical ink jet printer 54, having a host computer 50 coupled thereto, are illustrated. These various components include control electronics of the ink jet printer 54 which are used to control ink droplet ejection from the jets of a printhead cartridge 44 on a printhead carriage 42. The host computer 50 communicates with a processor 52 that is integral with the ink jet printer 54. The host computer 50 runs driver software which issues print commands and sends data to the ink jet printer 54. As in conventional ink jet printers, the processor 52 communicates with a display and keypad 56, memory 58, and drive circuits 60 which control the printhead carriage motor 62 and paper motor 63. In addition, the processor 52 routes signals to print logic 70, which actuates the jets of a printhead 72 of each printhead cartridge 44. In many embodiments of the present invention, the printer will include at least four ink jet cartridges, only one of which is illustrated in FIG. 1.

In addition to the items set forth above, the processor 52 also advantageously communicates with a memory element 78 on each cartridge 44. The information from the memory element 78 is communicated to the processor 52 via communication link 82 which may take a variety of forms. As will be explained in more detail below with reference to FIGS. 3 and 4, the memory element 78 may in some embodiments include an integrated circuit memory which interfaces with the processor 52 via a two wire electrical interface. The two-wire interface allows both reading from and writing to the memory element 78 by the processor 52. In one embodiment, the memory element 78 is non-volatile and is affixed to the cartridge 44 of FIG. 1 as will be explained below.

Based on the measurement of dot quality, line quality, or drop, the printer 54 can optimize printing for optimized image quality. The dot quality comprises the dot size, dot placement and dot shape. In general, the dot size is related to the image graininess and the printer "DPI"; and the dot placement and shape are related to the "banding" performance. The dot quality can be measured optically during manufacturing for each printhead manufactured. Dot quality can also be measured in printer during the life of a printhead. The operation can be manual, requiring printing and visual judgment, or the operation can be automated with optical sensors in printer. Another way to characterize basic ink on media quality related to the printhead is to measure the line quality. Parameters that affect line quality comprise line width, line placement and edge roughness. The dot quality is actually decided by the drop quality in flight. Drop quality comprises drop velocity and drop directionality. Drop velocity and drop directionality can be measured in factory for each printhead. Ink drop analysis is described in U.S. patent application Ser. No. 09/404,558, entitled Ink Droplet Analysis Apparatus, now U.S. Pat. No. 4,347,857, which is hereby incorporated in its entirety by reference. Printer 54 can optimize image quality in many ways. For example, heat can be supplied to the printhead 72 if its dot size or line width is small. Additionally, The drop ejection energy supplied to the resistor located in the printhead can be adjusted for optimized drop quality in flight and dot quality on media. The drop ejection energy adjustments can be achieved by adjusting electrical characteristics, such as drop ejection pulse shape, voltage and pulse width, and heater resistance in the case of thermal ink jet or capacitance of piezo element in the case of piezo electric ink jet. Other methods of optimizing image quality will be understood by those skilled in the art.

Also, the color-to-color alignment is measured to determine printhead performance. Poor alignment causes graininess or banding. In general, the color-to-color alignment is controlled by printhead-to-printhead alignment when ink color is differentiated by printhead. This is because that the jet-to-jet positioning in a printhead is made to be much more accurate than the head-to-head positioning, especially when the printhead is replaceable. The head-to-head alignment includes transitional and rotational alignment components. The color-to-color or head-to-head alignment can be measured in printer after printheads are installed. The operation can be manual or automated, requiring printing in both cases. Head-to-head alignment can be compensated in printer 54 for optimized image quality.

Therefore, there is a need for a system and method which monitors the performance of the printhead 72 in an ink jet printer 54. It would be advantageous if such a system was simple to implement and provided real-time information about the performance of the printhead 72 to the ink jet printer 54. Such information would permit the ink jet printer 54 to fine-tune the quality of the resulting image. Furthermore, the system would take advantage of the initial characteristics of the printhead 72, which are measured during fabrication. These characteristics would be stored within the memory element 78 on the cartridge 44 for access by the ink jet printer 54 with little or no user interaction.

For example, it is not desirable to provide an electrical pulse to the ejector located in the jet on the printhead with too high of a drop ejection energy. When the drop ejection energy is higher than a critical energy, the increasing drop ejection energy does not linearly increase drop quality. In the case of thermal ink jet, the "over energy" will not increase drop weight but instead increase the temperature of the ejected drop and the temperature of the printhead. High printhead temperature can cause the printhead reliability to degrade. In the case of piezo electric ink jet, the "over energy" causes both drop velocity and drop weight to increase. Too big of drop weight is related to too big of dot size, which is undesirable for high quality image printing.

Therefore, it is advantageous for the printer electronics to optimize drop ejection energy, including pulse shape, pulse voltage and pulse width based on the electrical characteristics of the jets on the printhead. It is also advantageous for the printer to optimize the drop ejection energy during the life of a printhead cartridge as the electrical characteristics for the jets change. In one embodiment with thermal ink jet printhead, the electrical characteristics comprise the resistances of the drop ejection resistors. In another embodiment with piezo electric ink jet printhead, the electrical characteristics comprise the capacitances of the piezo elements.

Due to the nature of the thermal ink jet technology, the overall printhead temperature is another important factor of drop ejection quality. During a drop ejection cycle, the heat from the resistor in a jet generates a vapor bubble to eject a drop out from the nozzle. The drop ejection energy is partially brought away by the ejected drop through kinetic energy and thermal energy. The left over part of the energy is kept in the printhead and causes bulk temperature rise of the ink and the structure. High temperature causes ink viscosity to decrease so drop weight and velocity will increase. When printhead temperature is too high, deprime of jets can occur.

To provide smaller drop weight variation, active heating can be applied to raise the operating temperature above a lower limit. A thermal sensing resistor (TSR) is built into the silicon die for temperature sensing. In one embodiment, the printhead has a bulk heater built in the silicon die for printhead heating. The bulk heater is turned on to heat the printhead to a desired temperature using a measured TSR resistance value. In one embodiment, the TSR has a range of 290–440 ohm, with coefficient 0.0003–0.0004 ohm/ohm/C. In another embodiment, the temperature sensor can be a thermistor. Other methods of heating the printhead are known to those skilled in the art.

In an embodiment using a piezoelectric ink jet printhead, the drop ejection pulse helps determine the drop ejection quality. The drop ejection pulse includes pulse shape, voltage, and pulse width. Though no heat is generated from the drop ejection in a piezoelectric printhead, drop weight can vary due to the environmental temperature. Printhead temperature control can be implemented, similar to the thermal ink jet printhead, for controlled drop weight or dot size on media.

When the cartridge 44 is installed in the ink jet printer, the communication link 82 between the memory element 78 and the processor 52 is established, and the processor 52 is able to retrieve and store sets of characteristics stored in the memory element 78. A variety of memory element characteristics and printer/cartridge interface designs are provided in U.S. Pat. No. 6,000,773 to Murray et al. entitled "Ink Jet Printer Having Ink Use Information Stored in a Memory Mounted on a Replaceable Printer Ink Cartridge", and U.S. Pat. No. 6,227,643 to Purcell et al entitled "Intelligent Printer Components and Printing System." The disclosures of both U.S. Pat. No. 6,000,773 and U.S. Pat. No. 6,227,643 are hereby incorporated by reference in their entireties, and the memory embodiments described therein may be used in conjunction with the present invention.

Figure 2:
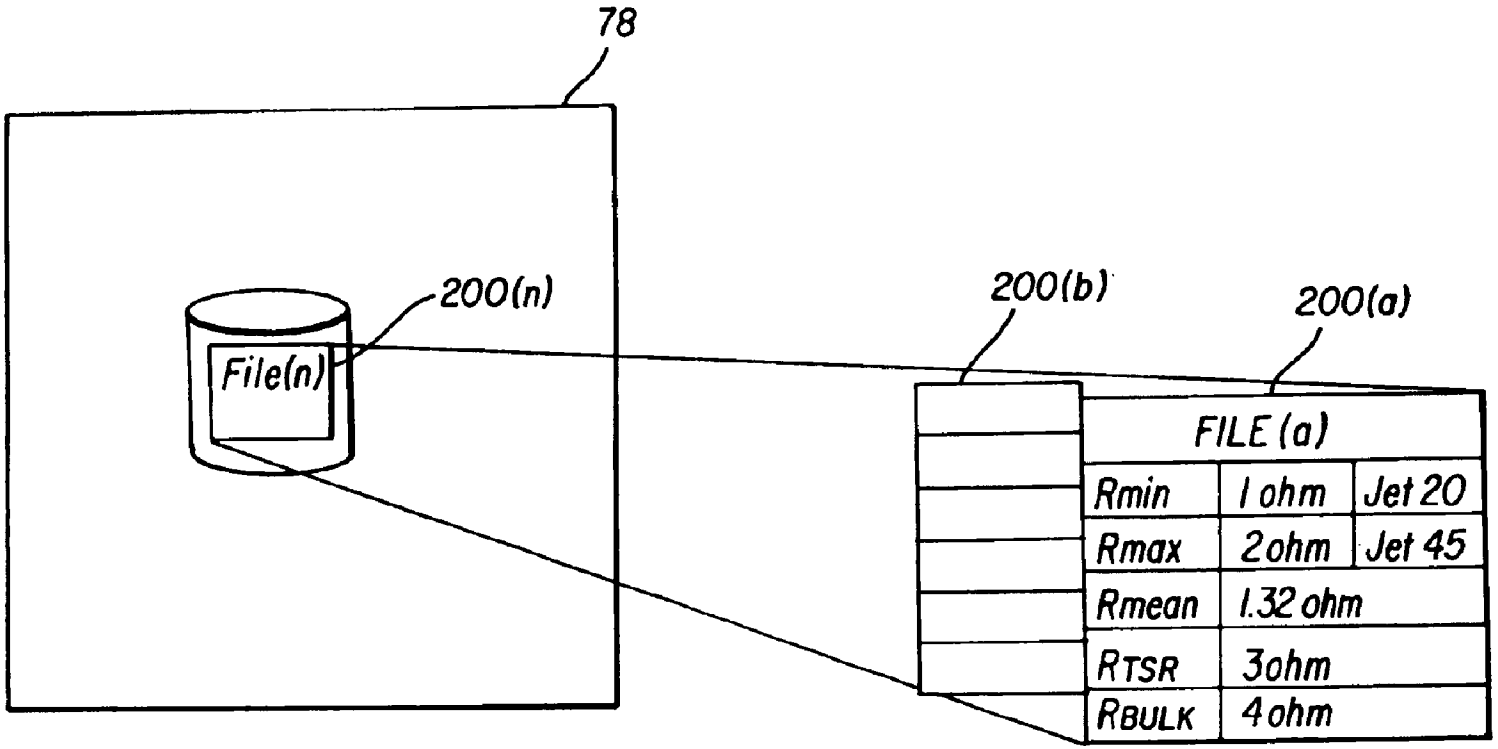
FIG. 2 is a diagram of a memory element, from FIG. 1, showing a set of characteristics for a printhead cartridge.

FIG. 2 illustrates a memory element 78 that stores various jet characteristics in files 200. In one embodiment for use with a thermal ink jet printer, a first set of the characteristics is stored in file 200 includes, for example, a maximum measured heater resistor value ("$R_{max}$"), a minimum measured heater resistor value ("$R_{min}$"), jet numbers for $R_{max}$ and $R_{min}$, a mean heater resistor value ("$R_{mean}$"), a thermal sensing resistor (TSR) value, and a bulk heater resistance value. In one embodiment, the heater resistor value is typically in the range of 25–43 ohm. Preferably, the first set of characteristics stored in file 200 is measured during fabrication of the cartridge 44 and stored in the memory element 78.

In an embodiment for use with a piezoelectric ink jet printer, the first set of characteristics may include, for example, a maximum and minimum piezo element capacitance and a maximum and minimum piezo element resonance frequency. As printhead temperature control can be implemented, similar to the thermal ink jet printhead, a thermister value and a bulk heater resistance value can be included.

Additionally, dot quality, or line quality, drop quality, or color-to-color alignment data can be stored in file 200 for embodiments for use with either thermal or piezoelectric ink jet printers. Dot quality comprises the dot size, dot placement and dot shape; Line quality comprises line width, line placement and edge roughness; drop quality comprises drop velocity and drop directionality. The dot quality, line quality or drop quality characteristics can be measured optically during manufacturing for each printhead manufactured. Determining these quality characteristics can be performed by inspection or the operation can be automated with optical sensors in the printer 54.

In some advantageous embodiments, upon installation of the cartridge 44 into the printer 54, a test procedure may be run to re-measure the jet characteristics to obtain a second set of characteristics. The processor 52 compares the second set of characteristics to the first set of characteristics stored in file 200. Methods for measuring jet characteristics may, for example, be performed as described in U.S. Pat. No. 6,302,511, entitled "Open jet compensation during multiple-pass printing," U.S. Pat. No. 6,199,969, entitled "Method and System for Detecting Nonfunctional Elements in an Ink Jet Printer," and Ser. No. 09/404,558, filed Sep. 23, 1999, entitled "Ink Droplet Analysis Apparatus now U.S. Pat. No. 6,347,157." The disclosures of these applications are incorporated herein by reference in their entireties. The measured values for jet characteristics may be stored as the second set of characteristics in memory 58. The second set of characteristics is compared by the processor 52 to the first set of characteristics stored in file 200 that was measured during fabrication of the cartridge 44.

The processor 52 may periodically re-measure the characteristics of the cartridge 44 as described above to generate additional sets of resistor data. These additional sets can then be compared with the first set of characteristics stored in file 200 in the memory element 78. Based on this comparison, the printing parameters, such as drop ejection energy and thermal control parameters, can be periodically adjusted so that the print quality produced by the cartridge 44 is again optimized for current cartridge conditions. If the most recent set of characteristics is outside of a tolerance limit and/or if changing the printing parameters cannot effectively compensate for this condition, the cartridge 44 may be flagged as unacceptable. The user may then be instructed to replace the cartridge 44. In one embodiment, the processor 52 uses the most recent set of characteristics stored in the memory 78 to automatically configure the printer 54 for optimal operation. Thus, optimal printing parameters, which were initially determined during fabrication, can be adjusted upon installation of a replacement cartridge 44 and during the life of the cartridge 44. The printer 54 is thus effectively re-programmed to optimize image quality.

For the embodiments of thermal ink jet, if heater resistance measurements made during the life of printhead agree with the first set of characteristics stored in file 200 within a desired tolerance, the processor 52 may use the measured heater resistance to calculate appropriate printing parameters, for example, thermal control and firing energy control parameters. If a heater resistance measurement made during the test deviates from the first set of characteristics by a predetermined tolerance, the processor 52 may mark the jet as defective, and use a jet replacement procedure to compensate for further printing. In one embodiment, such compensation is in accordance with U.S. Pat. No. 6,302,511. For example, the detection of an open jet or nozzle can initiate a compensation algorithm which substitutes with spare jets or which otherwise compensates for the open jet.

If too many heater resistance measurements deviate from the first set of characteristics by a predetermined tolerance amount such that substitution with spare jets is not possible or would unacceptably degrade the print quality, a "cartridge failed" message may be displayed on the display 56 of FIG. 1. This message indicates that the quality of the cartridge 44 has degraded since fabrication and should be replaced. During the life of the cartridge 44, the measured characteristics may progress through each range of tolerances such that the processor 52 makes different adjustments until the cartridge 44 is replaced.

Figure 3:
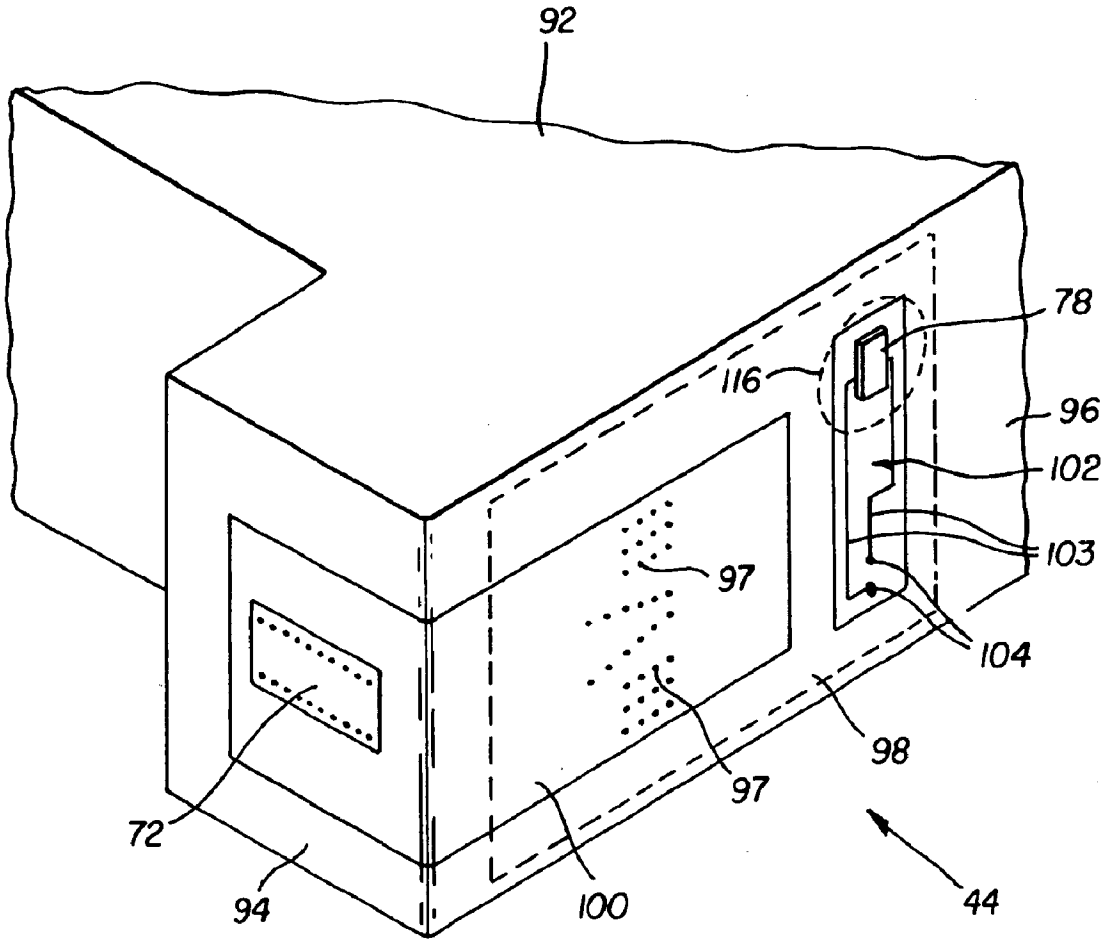
FIG. 3 is a perspective view of a portion of a cartridge including a memory element.

Referring now to FIG. 3, a perspective view of a portion of a thermal ink jet printhead cartridge 44 according to one embodiment is shown. The printhead cartridge 44 includes a housing 92 having a bottom surface 94 which provides a mounting surface for the printhead 72 (also illustrated in FIG. 2). The printhead 72 is connected to a piece of flex circuit 100 which extends from the bottom surface 94 of the cartridge 44 around a corner to the rear surface 96 of the cartridge. Circuit traces (not shown) connect the printhead 72 to contacts 97 which mate with contacts on the print carriage so as to connect the printer electronics with the printhead 72.

The printhead cartridge 44 further includes a memory element 78 (also illustrated in FIG. 2) comprising a memory integrated circuit. In this embodiment, a second piece of flex circuit 102 provides a mount for the memory element 78. Formed on the second flex circuit 102 are conductive traces 103 forming a two wire interface with the memory element 78. In some advantageous embodiments, the memory element 78 has only two electrically active terminals, one comprising a signal terminal, and one comprising a ground terminal. Memory elements which are suitable for use in some embodiments of the present invention are commercially available, for example, as part number DS2430A from Dallas Semiconductor of Dallas, Tex. These devices include 256 bits of EEPROM memory which is serially written to and read from over the one signal terminal provided. These devices also include a 48 bit serial number so that individual memory elements can be connected in parallel to a single signal line and addressed separately by an external device. Thus, a single two wire bus can be used to communicate in parallel with each of the plurality of cartridges provided on the ink jet printer.

Figure 4:
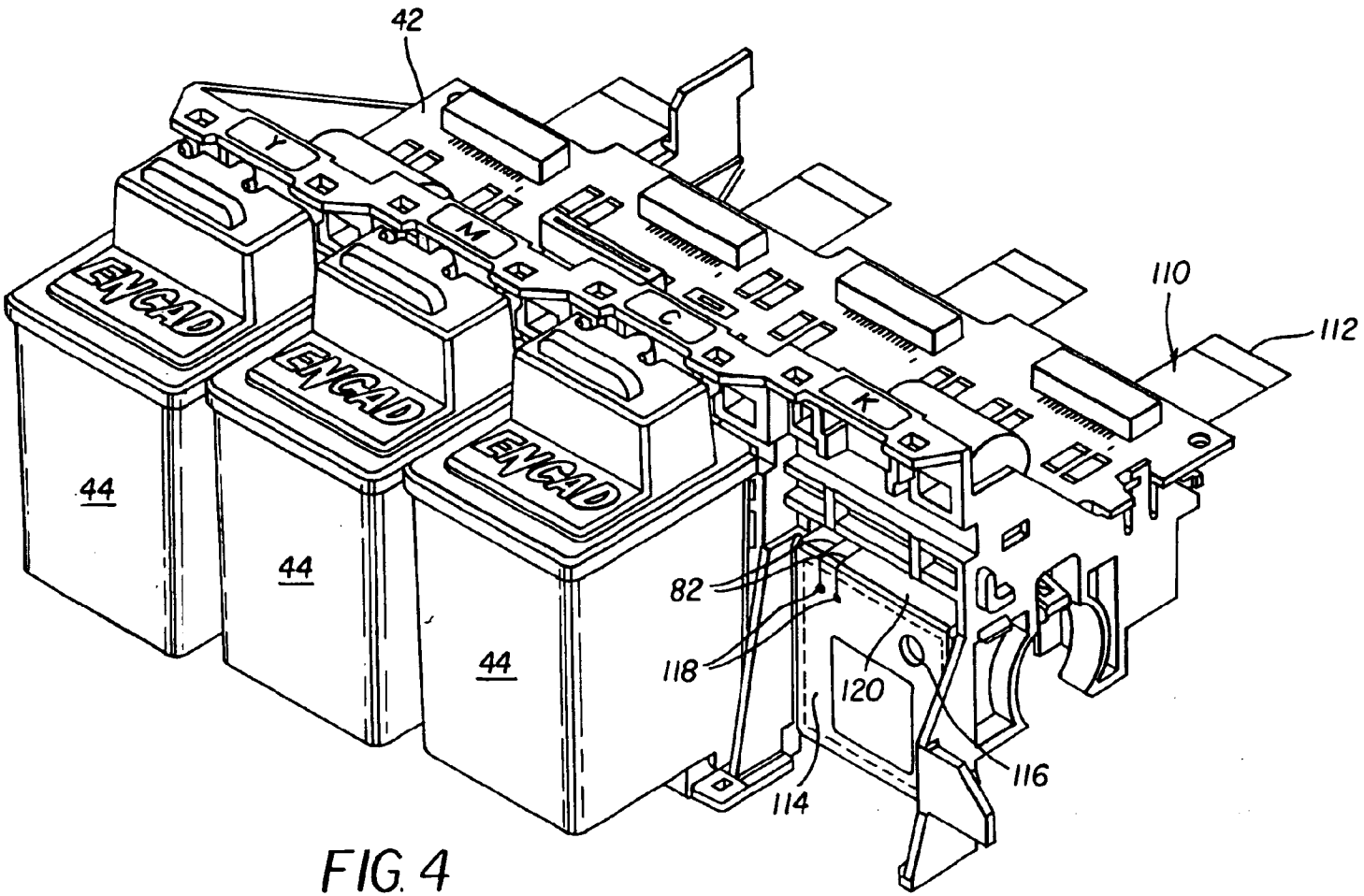
FIG. 4 is a perspective view of a print carriage showing a "drop & click" cartridge receptacle designed for receiving the cartridge from FIG. 3.

In the embodiment illustrated in FIG. 4, the flex circuit 102 is adhesively secured horizontally so as to extend across the rear surface 96 of the cartridge 44, and the memory element 78 comprises an unpackaged die which is mounted to the flex circuit 102 and connected to the two wire interface. The flex circuit 102 includes two contacts 104 for establishing an electrical connection to memory element interface circuitry which is routed to the printhead carriage 42.

Referring now to FIG. 4 in addition to FIG. 3, the ink jet cartridge rear surface 96 includes a carriage interface portion 98, indicated in FIG. 3 by a dashed line on the rear surface 96 of the cartridge 44. The carriage interface portion 98 of this flex circuit 100 makes contact with another flex circuit 110 which is mounted to the printhead carriage 42. The carriage mounted flex circuit 110 thus includes a printer I/O portion 112 at one end, and a cartridge interface portion 114 at the other end, which is shown in FIG. 4 as bounded by a dashed line. In some embodiments of the present invention, the flex circuit 110 further includes an aperture or cavity 116 to make space for the memory element 78 when the cartridge 44 is installed in the printhead carriage 42. The flex circuit 110 also includes traces which form a portion of a two wire interface 82, and contacts 118 which connects to the contacts 104 on the cartridge flex circuit 102 which includes the memory element 78.

Still referring to FIG. 4, the flex circuit 110 is attached to the carriage such that the cartridge interface portion 114 is on a vertical surface at the rear of the cartridge receptacle. The remainder of the flex circuit 110 is threaded through a horizontally extending slot 120 in the carriage so that the printer I/O end 112 of the flex circuit 110 extends out the back of the carriage to interface with the printer electronics. It will be appreciated by examination of FIG. 4 that when the cartridge 44 is installed into the carriage, the carriage interface portion 98 of the flex circuit 100 on the cartridge will contact the cartridge interface portion 112 of the flex circuit 110 on the carriage. This operation will connect the printhead 72 to the printer electronics, and will also connect the two wire interface contacts 118 on the carriage to the two wire interface contacts 104 on the cartridge 44.

Thus, a printer with an intelligent cartridge quality management system can be used to consistently output high quality prints throughout the life of the ink jet printer. With this system and method, printhead quality can be periodically optimized based on measurements of key printhead characteristics. Any printhead quality deviation can be detected and compensated for. In addition, the printer can determine whether or not a failed cartridge qualifies for a warranty replacement, eliminating any dependence on user judgement on this question. This information may be made available to the operator (either through the host software or from an integral printer LCD display).

The foregoing description details certain embodiments of the present invention and describes the best mode contemplated. It will be appreciated, however, that no matter how detailed the foregoing appears in text, the invention can be practiced in many ways. It should be noted that the use of particular terminology when describing certain features or aspects of the present invention should not be taken to imply that the broadest reasonable meaning of such terminology is not intended, or that the terminology is being redefined herein to be restricted to including any specific characteristics of the features or aspects of the invention with which that terminology is associated. The scope of the present invention should therefore be construed in accordance with the appended claims and any equivalents thereof.

What is claimed is:

1. In an ink jet printer comprising a printhead cartridge, said printhead cartridge having a printhead comprising a plurality of jets thereto a method of testing said printhead, said method comprising:

storing in a memory element on said printhead cartridge a first set of jet characteristics of said printhead, wherein said first set of characteristics is indicative of the performance of said plurality of jets;

testing said printhead cartridge to generate a second set of jet characteristics, wherein said first and second set of characteristics are resistance values of resisters on said printhead; and comparing said second set of jet characteristics with said first set of jet characteristics.

2. The method of claim 1, further including adjusting a printer parameter to optimize said printer for said cartridge based on said comparison.

3. The method of claim 1, wherein said first set of characteristics comprises at least maximum and minimum expected resistance values.

4. The method of claim 3, wherein said second set of characteristics comprises resistance values for a plurality of jet resistors.

5. The method of claim 4, wherein comparing said second set of characteristics with said first set of characteristics includes comparing the resistance of a jet resistor with the maximum and minimum expected resistance value for the jet resistors.

6. The method of claim 4, wherein said printhead cartridge is tested upon installation in said printer to generate said second set of characteristics.

7. The method of claim 3, wherein said first set of characteristics is stored during the manufacturing process of said printhead cartridge.

8. The method of claim 1, wherein said first and second set of characteristics are capacitance and/or resonance frequencies of piezo elements on said printhead.

9. The method of claim 8, wherein said first set of characteristics comprises at least maximum and minimum expected capacitance values.

10. The method of claim 9, wherein said second set of characteristics comprises capacitance values for a plurality of jet piezo elements.

11. The method of claim 1, wherein said first and second set of characteristics are selected from the group consisting of: dot quality, line quality, drop quality or color-to-color alignment.

12. The method of claim 1, wherein the printhead cartridge resides on a movable carriage.

13. The method of claim 1, wherein said second set of characteristics is compared with said first set of characteristics to determine if said printer is optimized for said cartridge.

14. A printhead cartridge comprising:

a housing;

a printhead mounted to said housing and including a plurality of jets thereon; and an integrated circuit mounted to the housing, said integrated circuit comprising a memory element, wherein said memory element stores at least one set of jet characteristics, including maximum and minimum resistance values of resisters on said printhead.

15. The printhead cartridge of claim 14, further containing a plurality of electrical contacts configured to electrically connect said integrated circuit with a processor, wherein said processor compares a second set of jet characteristics with said at least one set of jet characteristics.

16. The printhead cartridge of claim 14, wherein said at least one set of characteristics comprises characteristics selected from the group consisting of: dot quality, line quality, drop quality or color-to-color alignment.

17. A printhead cartridge comprising:

a housing;

a printhead mounted to said housing and including a plurality of jets thereon; and an integrated circuit mounted to the housing, said integrated circuit comprising a memory element, wherein said memory element stores at least one set of jet characteristics, including capacitance and/or resonance frequencies of piezo elements on said printhead.

18. A printhead cartridge comprising:

a housing;

a printhead mounted to said housing and including a plurality of jets thereon; and an integrated circuit mounted to the housing, said integrated circuit comprising a memory element, wherein said memory element stores at least one set of jet characteristics, including at least expected capacitance values for piezo elements on said printhead.

19. A printhead cartridge comprising:

a housing;

a printhead mounted to said housing and including a plurality of jets thereon; and an integrated circuit mounted to the housing, said integrated circuit comprising a memory element, wherein said memory element stores at least one set of jet characteristics, including resonance frequency values for piezo elements on said printhead.

20. A printer comprising:

a cartridge, said cartridge comprising:

a housing;

a printhead mounted to said housing and including a plurality of jets thereon;

an integrated circuit mounted to housing, said integrated circuit comprising a memory element, wherein said memory element stores a first set of characteristics of said plurality of jets, wherein said first set of characteristics comprises maximum and minimum expected resistance values of resistors on said printhead cartridge;

a memory, wherein said memory stores a second set of characteristics of the plurality of jets, wherein said second set of characteristics comprises measured resistance values for the plurality of jet resistors; and a processor connected to the integrated circuit by a plurality of electrical contacts, wherein said processor compares said second set of characteristics with said first set of characteristics.

21. A method of detecting malfunctioning jets of an ink jet printhead cartridge comprising:

storing at least one jet resistance value in a memory on said cartridge, and comparing a measured resistance value to said stored value.

22. A printhead cartridge comprising:

a housing;

a printhead mounted to said housing and including a plurality of jets thereon; and an integrated circuit mounted to the housing, said integrated circuit comprising a memory element, wherein said memory element stores at least one set of resistance values of resisters on said printhead, said at least one set of resistance values comprising a first set of characteristics including maximum and minimum expected resistance values for resistors on said printhead.

23. In an ink jet printer comprising a printhead cartridge, said printhead cartridge having a printhead comprising a plurality of jets thereto a method of testing said printhead, said method comprising:

storing in a memory element a first set of jet characteristics comprising a plurality of resistance values for resistors on said printhead, wherein said first set of characteristics is indicative of the performance of said plurality of jets;

testing said printhead cartridge to generate a second set of jet characteristics comprising a plurality of resistance values for said resistors;

comparing said second set of jet characteristics with said first set of jet characteristics; and adjusting a printer parameter to optimize said printer for said cartridge based on said comparison.

24. A printer comprising:

a cartridge, said cartridge comprising:

a housing;

a printhead mounted to said housing and including a plurality of jets thereon, wherein each jet has a piezo element;

an integrated circuit mounted to housing, said integrated circuit comprising a memory element, wherein said memory element stores a first set of characteristics of said plurality of jets, wherein said first set of characteristics comprises expect capacitance values for the piezo elements on said printhead;

a memory, wherein said memory stores a second set of characteristics of the plurality of jets, wherein said second set of characteristics comprises measured capacitance values for the piezo elements on said printhead; and a processor connected to the integrated circuit by a plurality of electrical contacts, wherein said processor compares said second set of characteristics with said first set of characteristics.

* * * * *